US006000870A

United States Patent [19]

Koga

[11] Patent Number: 6,000,870

[45] Date of Patent: Dec. 14, 1999

[54] PRINTING DEVICE HAVING DUAL SHEET FEED TRAYS

[75] Inventor: Yuji Koga, Nagoya, Japan

[73] Assignee: Brother Kogyo Kabushiki Kaisha, Nagoya, Japan

[21] Appl. No.: 08/949,457

[22] Filed: Oct. 14, 1997

[30] Foreign Application Priority Data

Oct. 14, 1996 [JP] Japan ..... 8-293223
Oct. 15, 1996 [JP] Japan ..... 8-294427

[51] Int. Cl.[6] ..... B41J 11/50

[52] U.S. Cl. ..... 400/605; 400/624; 271/145

[58] Field of Search ..... 400/605, 606, 400/607, 624, 625, 629, 708, 636; 271/9, 145

[56] References Cited

U.S. PATENT DOCUMENTS

| | | | |
|---|---|---|---|
| 4,248,415 | 2/1981 | Steinhilber | 271/9 |
| 4,667,947 | 5/1987 | Costa et al. | 400/624 |
| 4,789,258 | 12/1988 | Gomoll et al. | 400/605 |
| 5,035,413 | 7/1991 | Yamada et al. | 400/605 |
| 5,054,759 | 10/1991 | Lohrmann et al. | 400/624 |
| 5,066,151 | 11/1991 | Durr et al. | 400/605 |
| 5,080,515 | 1/1992 | Engelhardt et al. | 400/624 |
| 5,082,384 | 1/1992 | Kakaguchi | 400/708 |
| 5,222,722 | 6/1993 | Kamano | 271/145 |

FOREIGN PATENT DOCUMENTS

| | | | |
|---|---|---|---|
| 235 633 | 9/1987 | European Pat. Off. | 400/605 |
| 2-253340 | 11/1990 | Japan . | |

*Primary Examiner*—Christopher A. Bennett
*Attorney, Agent, or Firm*—Oliff & Berridge, PLC

[57] ABSTRACT

A laser printer having two sheet feed trays mounted in the top of its case, enabling two different sizes of sheet to be loaded in the printer or increasing the sheet capacity of the printing device by providing the same type of sheet in both trays. The first tray nearest to the back end of the printer extends only a short distance over the end of the printer case so that the printer occupies little space, and the overall height of the case need not be increased. The second tray can be removed to reveal a sheet conveying path from the first tray, facilitating the removal of jammed sheet.

15 Claims, 11 Drawing Sheets

PRINTING DEVICE HAVING DUAL SHEET FEED TRAYS

BACKGROUND OF THE INVENTION

The present invention relates to a printing device, and more particularly, to a printing device provided with two sheet feed trays on a top surface of a body case, which trays are capable of feeding sheet into a printing mechanism.

Conventionally, printing devices are provided with a fixed sheet feed tray or a removable sheet feed tray, usually called a sheet feed cartridge, for feeding each one of sheets to be printed into a printing region. Since printing devices are required to have a more compact structure than photocopying devices and since a sheet conveying mechanism and a printing mechanism inside the printing device must operate in interlocking relation with each other during the printing operation, conventional printing devices have been equipped with only one fixed or removable sheet feed tray for feeding sheet. Thus, conventional printing devices can provide only one type of sheet during a printing process. Moreover, when using removable sheet feed trays with conventional printing devices, only one tray of a plurality of feed trays, each containing a different size of printing sheet, is selectively mounted in the printing device.

Since only one sheet feed tray is mounted in conventional printing devices, such inconvenient operations as exchanging sheet or removable sheet feed trays are frequently necessary when printing on different sizes of sheet. Further, the sheet supply in the trays must be frequently replenished because the number of sheets that can be contained in the trays is limited.

Further, conventional removable sheet feed trays are mounted horizontally in a mounting section on the front or back surface of a body case so that about one-half the length of the sheet feed tray is extending out of the body case. Therefore, the overall front-to-back length of the printing device is large, and the printing device occupies much space.

In another aspect, conventional fixed sheet feed trays include a sheet receiving unit for receiving and guiding numerous sheets of sheet, and a slider for regulating the sheet width. On the other hand, conventional removable sheet feed trays include a box-shaped cassette case, a sheet receiving plate provided on the bottom portion of the cassette case for receiving sheet, and a cover plate detachably mounted on the top surface of the cassette case. Sheet feed rollers are not mounted in the removable sheet feed trays. Instead, sheet conveying mechanism including a set of sheet feed rollers is fixedly mounted in the body case of the conventional printing devices.

Since the sheet conveying mechanism including the set of sheet feed rollers is fixedly mounted in the body case, it is difficult to mount a plurality of sheet feed trays in the body case. In other words, since the sheet feed trays must be positioned near the set of sheet feed rollers in order for the rollers to feed sheet from the trays, it is not remotely possible to configure the printing device so that one set of sheet feed rollers can supply sheet from a plurality of sheet feed trays. In addition, the configuration of the printing device must be such that sheet becoming jammed in the sheet feed passage can be removed. However, this is difficult when supplying sheet from a plurality of trays because of restrictions on the structure of the sheet feed passage.

Japanese Patent Application Kokai (OPI) No. HEI-2-53340 discloses a copying machine in which a plurality of removable sheet feed trays are mounted in a body case, and feed rollers corresponding to these sheet feed trays are provided inside the body case, enabling sheet to be alternatively fed from any of the plurality of sheet feed trays. However, the mounting sections for the plurality of sheet feed trays are provided at a plurality of levels, increasing the overall height of the body case.

If this arrangement is applied into a printer, a body case of the printer becomes bulky so as to install a plurality of sheet feed trays arrayed in a vertical direction. Intricate sheet feed mechanism and its driving system result.

In still another aspect, the sheet feed mechanism of the printer is provided for feeding the sheet fed from the sheet feed tray to the printing mechanism. The sheet feed mechanism includes a register roller and a sheet detection mechanism positioned upstream of the register roller for detecting a leading edge of the sheet. The sheet detection mechanism detects the leading edge of the sheet, and the leading end of the detected sheet is brought into abutment with the register roller so as to control sheet feeding amount after the abutment. The sheet detection mechanism includes a detection piece pivotally movable toward and away from the sheet feed passage, one or a plurality of lever members positioned at one widthwise side of the sheet feed passage and movable in interlocking relation with the detection piece, and a sensor for detecting the movement of the lever members. Therefore, if a plurality of sheet feed trays are installed on the body case, a plurality of detecting pieces must be provided and therefore, a plurality of sensors must be correspondingly required. This may be costly due to the increase in electrical components and complexity in a control arrangement.

Further, if a plurality of sheet feed trays are installed on the body case of the printing device, complex sheet feed passages result, since the plurality of sheet feed passages from the plurality of sheet feed trays reach the common register roller. Furthermore, one sheet feed passage may become excessively long or may be hidden behind other mechanism. As a result, it becomes difficult to provide a wide open space over the sheet feed passage so as to deal with sheet jamming.

Moreover, it becomes difficult to position the sheet detection piece of the sheet detection mechanism in the vicinity of the register roller in such a complicated sheet feed passages. Further, the sheet detection piece must be located at a place capable of facilitating inspection and maintenance thereof. However, the sheet detecting mechanism requires large installation space. Accordingly, it would be extremely difficult to dispose a plurality of sheet detection mechanisms in the body case. If the detection piece is positioned remote from the register roller, sheet feeding accuracy may be lowered.

SUMMARY OF THE INVENTION

In view of the foregoing, it is an object of the present invention to provide a printing device mounted with two sheet feed trays capable of either alternatively supplying sheet of two different sizes or increasing the sheet capacity of the printing device.

Another object of the present invention is to provide the printing device having a compact size or overall horizontal length and without increase in height of a body case in spite of the provision of dual sheet feed trays.

Still another object of the present invention is to provide such printer capable of facilitating removal of a jammed sheet.

Still another object of the present invention is to provide such printer having one detachably mounted sheet feed tray and from which a sheet can be supplied.

Still another object of the present invention is to provide the printer capable of facilitating replenishment of sheets in the sheet feed trays.

Still another object of the present invention is to provide the printer having a mechanically simplified sheet feed mechanism for feeding sheets from the detachably mounted sheet feed trays.

Still another object of the present invention is to provide the printer capable of providing sheet feed with high accuracy.

Still another object of the present invention is to provide the printer having a compact and low cost mechanism for detecting a leading edge of the sheet supplied from either one of the sheet feed trays.

These and other objects of the present invention will be attained by a printing device including a body case having a top surface and first and second sheet feed tray units. The first sheet feed tray unit is provided to the top surface and at a rearmost section thereof. The first sheet feed tray unit is in a backward rising inclination and replenishingly accommodates therein a plurality of sheets. The second sheet feed tray unit is detachably provided to the top surface and at a position in front of the first sheet feed tray unit. The second sheet feed tray unit is in a backward rising inclination and repleneshingly accommodates therein a plurality of sheets.

In another aspect of the invention there is provided a printing device including the body case, the first and second sheet feed tray units, a first passage means, a register roller and a sheet detection mechanism. The first passage means is provided in the body case. A sheet supplied from the first sheet feed tray unit is fed in a sheet feeding direction on the first passage means. The first passage extends over a position immediately below the second sheet feed tray unit. The register roller is positioned in front of a lower end of the second sheet feed tray and along the first passage means for position-registering the sheet supplied from either the first sheet feed tray unit or the second sheet feed tray unit. The second sheet feed tray defines therein a second passage means directing to the register roller. The sheet detection mechanism includes a first detection piece protrudable into and retractable from the first passage means for detecting a leading end of a sheet fed from the first sheet feed tray unit and a second detection piece protrudable into and retractable from the second passage means for detecting a leading end of a sheet fed from the second sheet feed tray unit.

DETAILED DESCRIPTION OF THE PREFERRED EMBODIMENT

Figure 1:
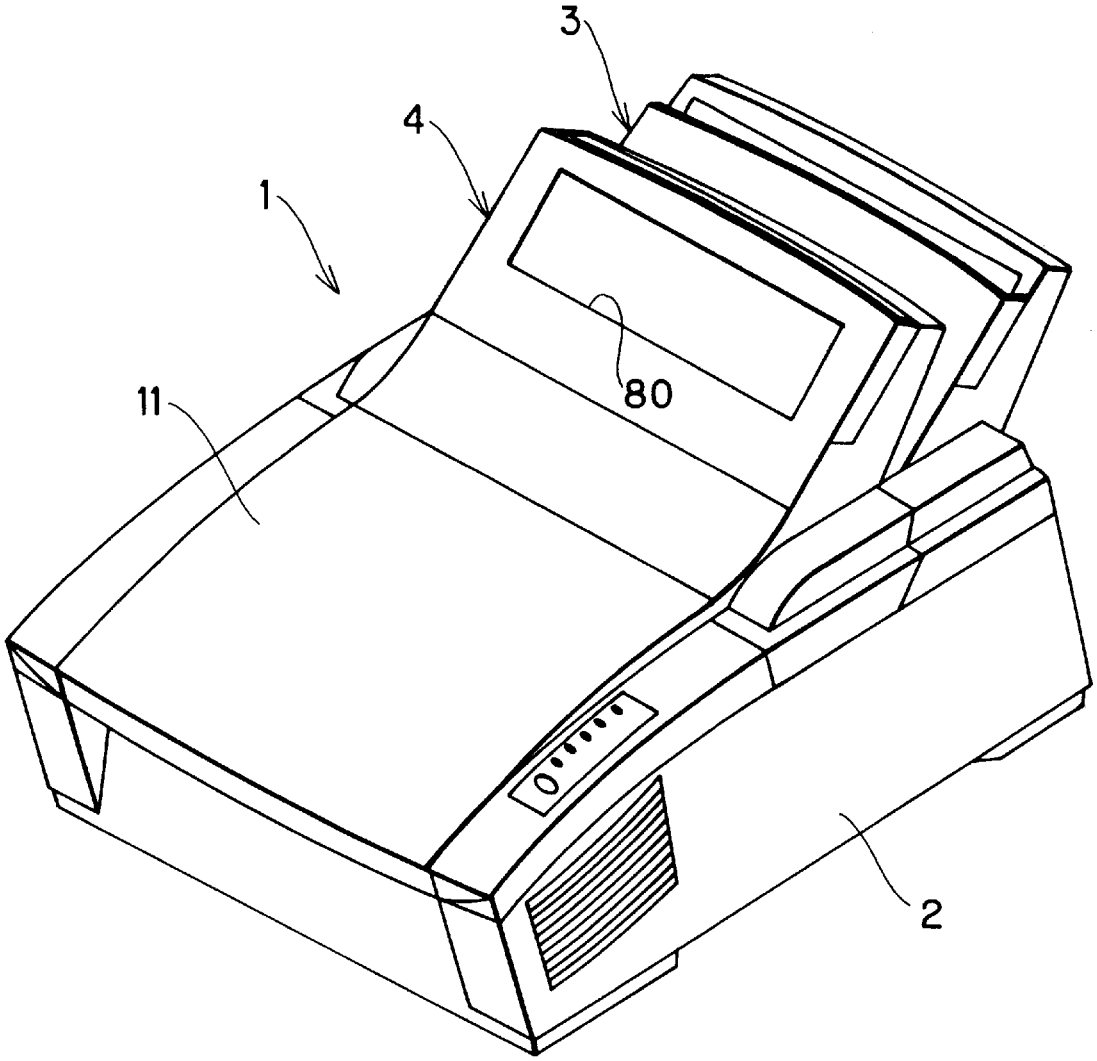
FIG. 1 is a perspective view showing a laser printer according to one embodiment of the present invention.
Figure 2:
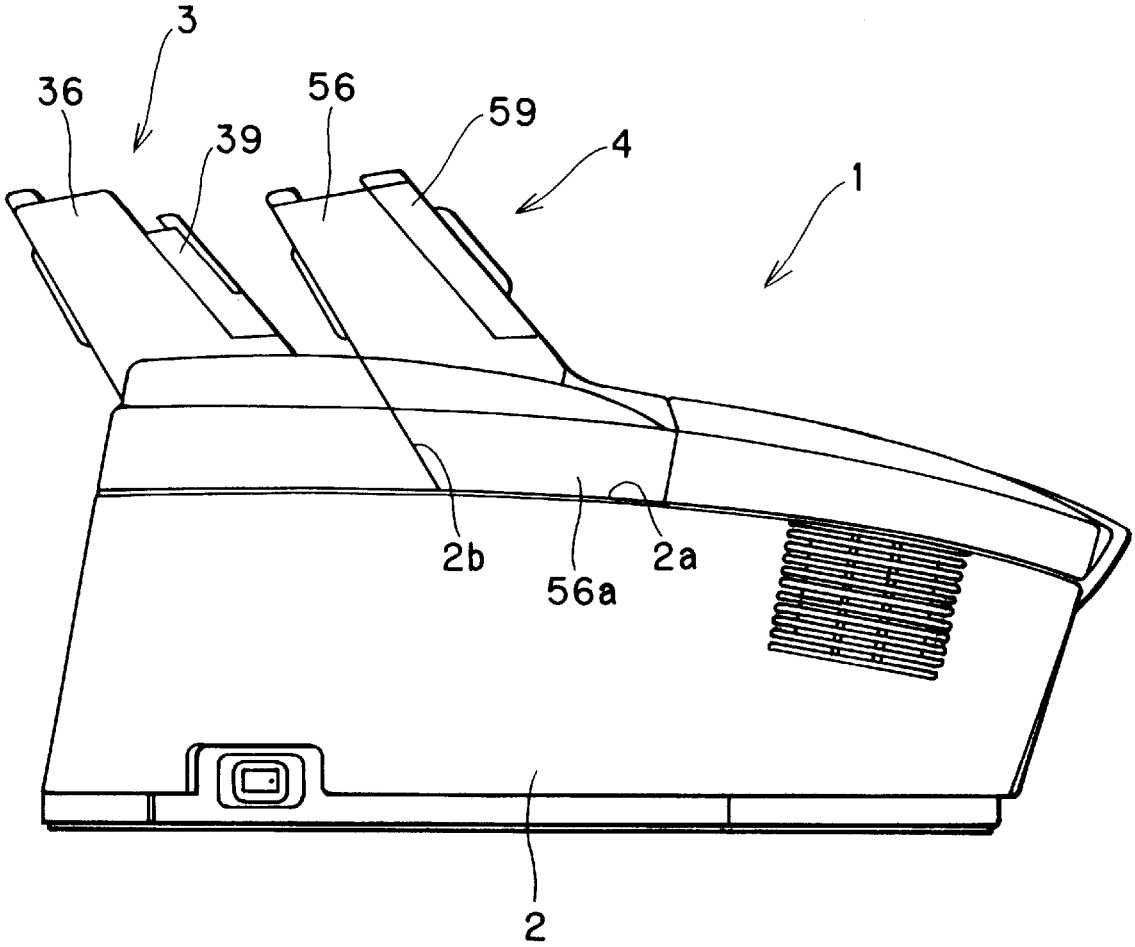
FIG. 2 is a side view showing the printer in FIG. 1.
Figure 3:
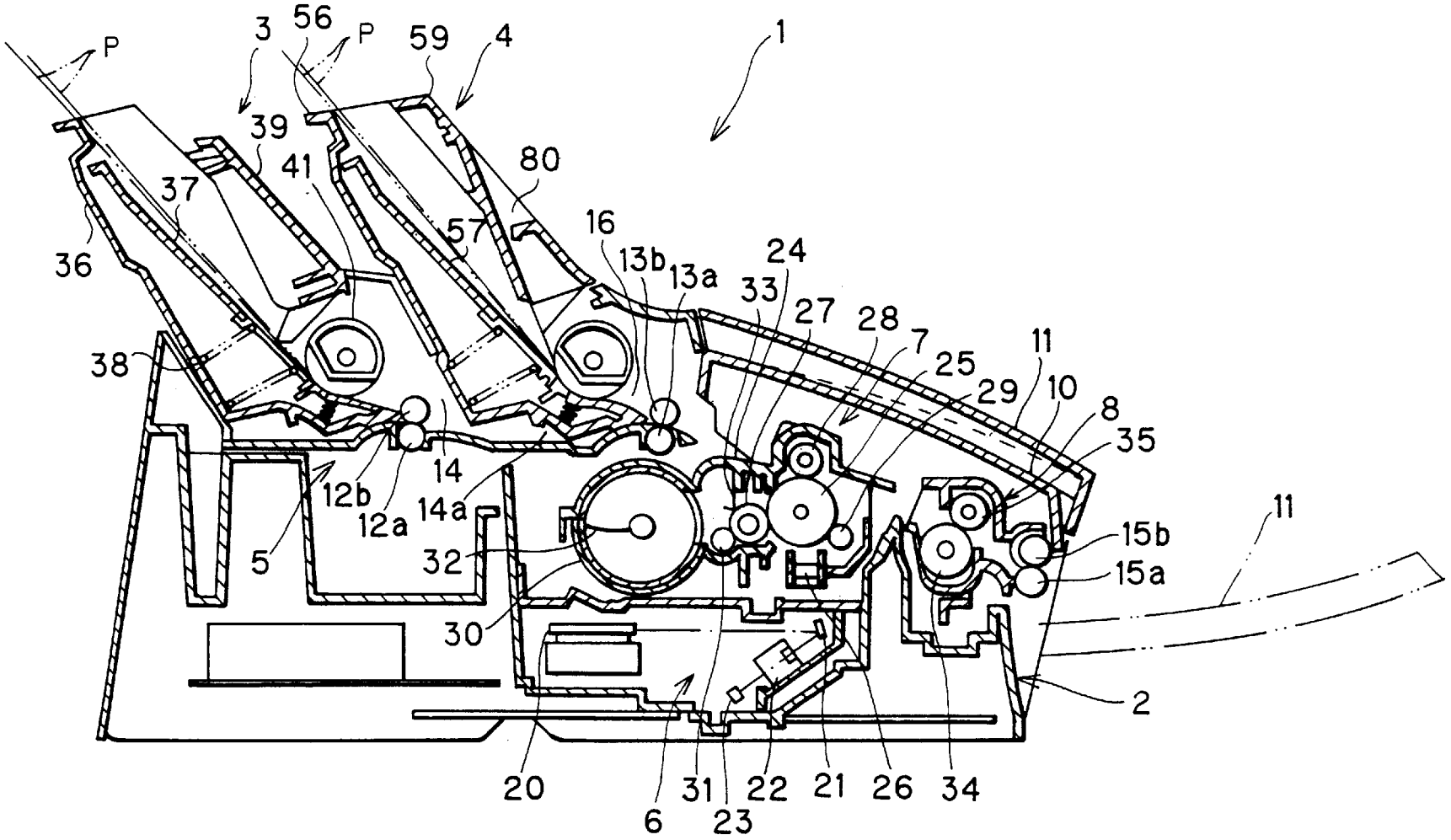
FIG. 3 is a side cross-sectional view showing the printer in FIG. 1.

A printing device according to one embodiment of the present invention will be described with reference to FIGS. 1 through 8. As shown in FIGS. 1 through 3, the printing device pertains to a laser printer 1 which includes a body case 2, first and second sheet feed tray units 3 and 4 provided on the top surface and back section of the body case 2, and a receiving tray 11. Inside the body case 2 are provided a sheet feed mechanism 5, a scanner unit 6, a processing unit 7, a fixing unit 8, and a drive unit (not shown). The drive unit is housed in the left side section of the body case 2 for driving first and second sheet supplying mechanisms 43 (FIG. 4) and 63 (FIG. 6) of the first and second sheet feed tray units 3 and 4, the sheet feed mechanism 5, the processing unit 7, the fixing unit 8, and the like. A top cover 10 capable of opening to expose a printing mechanism is provided on the top surface front section of the body case 2 beneath the receiving tray 11. The receiving tray 11 can be switched freely between a closed position, as shown by a solid line in FIG. 3, and an open position, shown by a two dotted chain line in FIG. 3. When in the open position, the receiving tray 11 serves as a tray for receiving sheet that has been printed.

Here, a combination of the scanner unit 6, processing unit 7, and fixing unit 8 provides the printing mechanism. The processing unit 7 is configured as a cartridge that is removably mounted in a specified area within the body case 2. The processing unit 7 includes a casing 24. Within the casing 24 are housed a photosensitive drum 25, a scorotoron charger 26, a developing roller 27, a transfer roller 28, a cleaning roller 29, a toner box 30, a toner supply roller 31, and the like.

The first sheet feed tray unit 3 is fixedly provided on the top surface near the back end of the body case 2. The second sheet feed tray unit 4 is detachably provided on the top surface of the body case 2 in front of the first sheet feed tray unit 3.

The sheet feed mechanism 5 conveys sheet supplied alternatively from the first and second sheet feed tray units 3 and 4 to the processing unit 7. To achieve this, the sheet conveying mechanism 5 includes a pair of feed rollers 12*a* and 12*b*, which are provided on the lower side of the first sheet feed tray unit 3, and a pair of register rollers 13*a* and 13*b*, which are provided on the lower front side of the second sheet feed tray unit 4 and provided to the body case 2. The feed roller 12*a* is a drive roller, and the feed roller 12*b* is a follower roller. Similarly, the register roller 13*a* is a drive roller, while the register roller 13*b* is a follower roller. A sheet feed path 14, which extends from the first sheet feed tray unit 3 to the register rollers 13*a* and 13*b* includes an underside conveying path 14*a* extending along the lower surface of the second sheet feed tray unit 4, such that the underside conveying path 14*a* is exposed when the second sheet feed tray unit 4 is removed from the body case 2. A major part of the sheet conveying path 14 is constructed by the underside conveying path 14*a*. Sheet supplied from the first sheet feed tray unit 3 is driven by the feed rollers 12*a* and 12*b* along the underside conveying path 14*a* to the register rollers 13*a* and 13*b*. After the sheet is registered by the register rollers 13*a* and 13*b*, the sheet is conveyed to the processing unit 7. Sheet supplied from the second sheet feed tray unit 4 is conveyed along a conveying path 16 to the register rollers 13*a* and 13*b*. After being registered, the sheet is conveyed to the processing unit 7.

The scanner unit 6 is positioned on the lower side of the processing unit 7, and includes a laser emitting portion (not shown), a polygon mirror 20, reflecting mirrors 21 and 23, and a lens 22. As indicated by a dotted chain line in FIG. 3, through high-speed scanning, a laser beam from the laser emitting portion is radiated via the polygon mirror 20, reflecting mirror 21, lens 22, and reflecting mirror 23 to expose the cylindrical surface of the rotating photosensitive drum 25, which is charged by the charger 26 in the processing unit 7. Such exposure forms an electrostatic latent image on the surface of the photosensitive drum 25.

The toner box 30 contained in the casing 24 of the processing unit 7, can be replenished with toner by removing the processing unit 7 from the body case 2. An agitator 32 is disposed in the processing unit 7 for agitating the toner within the toner box 30, releasing toner onto the toner supply roller 31, via which roller toner is supplied to the developing roller 27. A blade 33 is provided to maintain a uniform layer of toner on the developing roller 27, which toner is supplied to the photosensitive drum 25. The toner supplied from the developing roller 27 adheres to the latent image area formed on the surface of the photosensitive drum 25, so that a visible toner image corresponding to the latent image is formed on the drum 25. The toner image on the drum 25 is then transferred to the sheet as the sheet passes between the photosensitive drum 25 and the transfer roller 28. Next, the sheet is conveyed through the fixing unit 8 to fix the image. Toner remaining on the surface of the photosensitive drum 25 is temporarily collected by the cleaning roller 29 and then collected by the developing roller 27 via the photosensitive drum 25 at a prescribed timing. The fixing unit 8 includes a heat roller 34 for thermally fixing the toner on the sheet, a pressure roller 35 which maintains pressure with the heat roller 34, and a pair of delivery rollers 15*a* and 15*b* provided downstream of the rollers 34 and 35 for delivering the sheet out of the body case 2.

Figure 4:
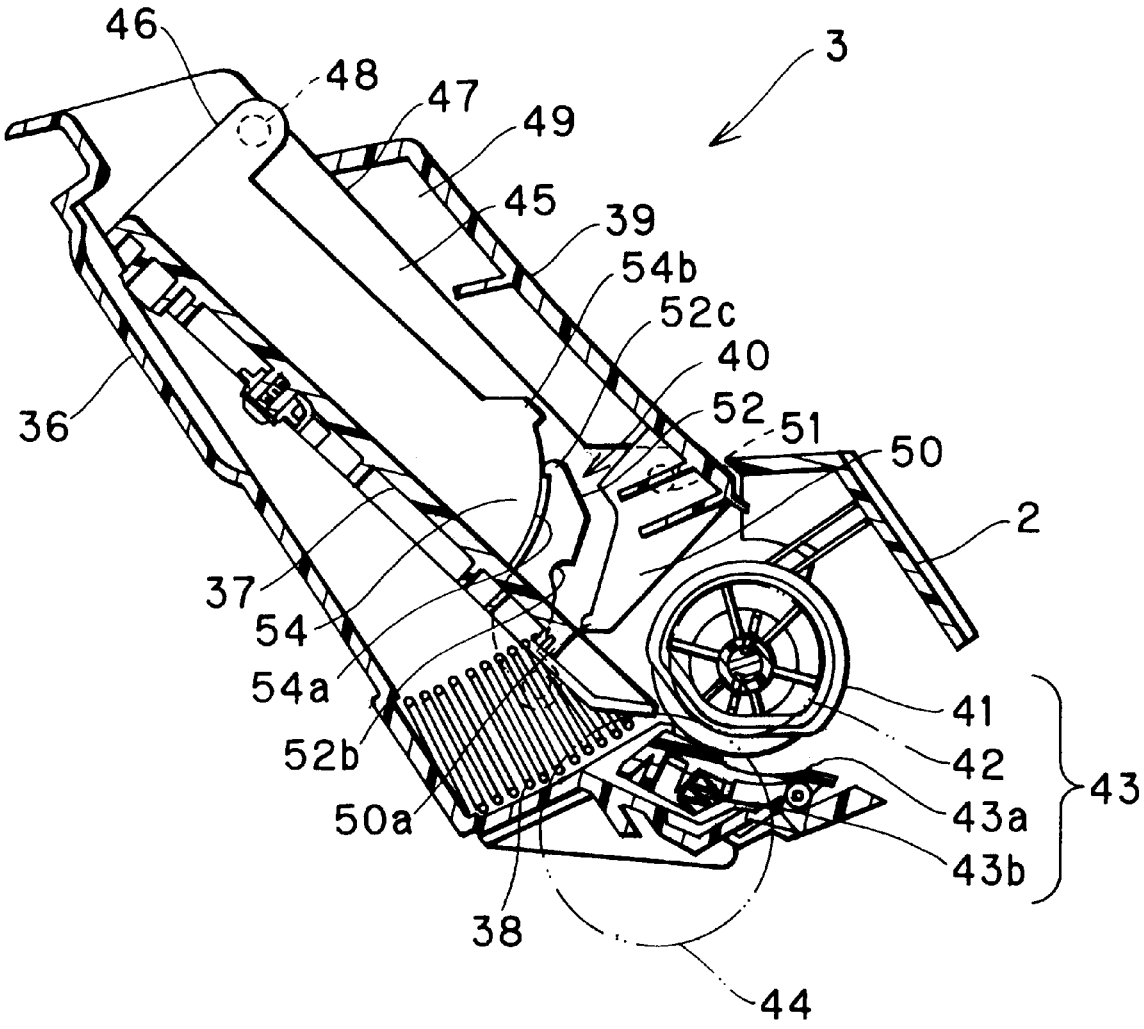
FIG. 4 is a side cross-sectional view showing a first sheet feed tray unit with a tray cover closed according to the embodiment.
Figure 5:
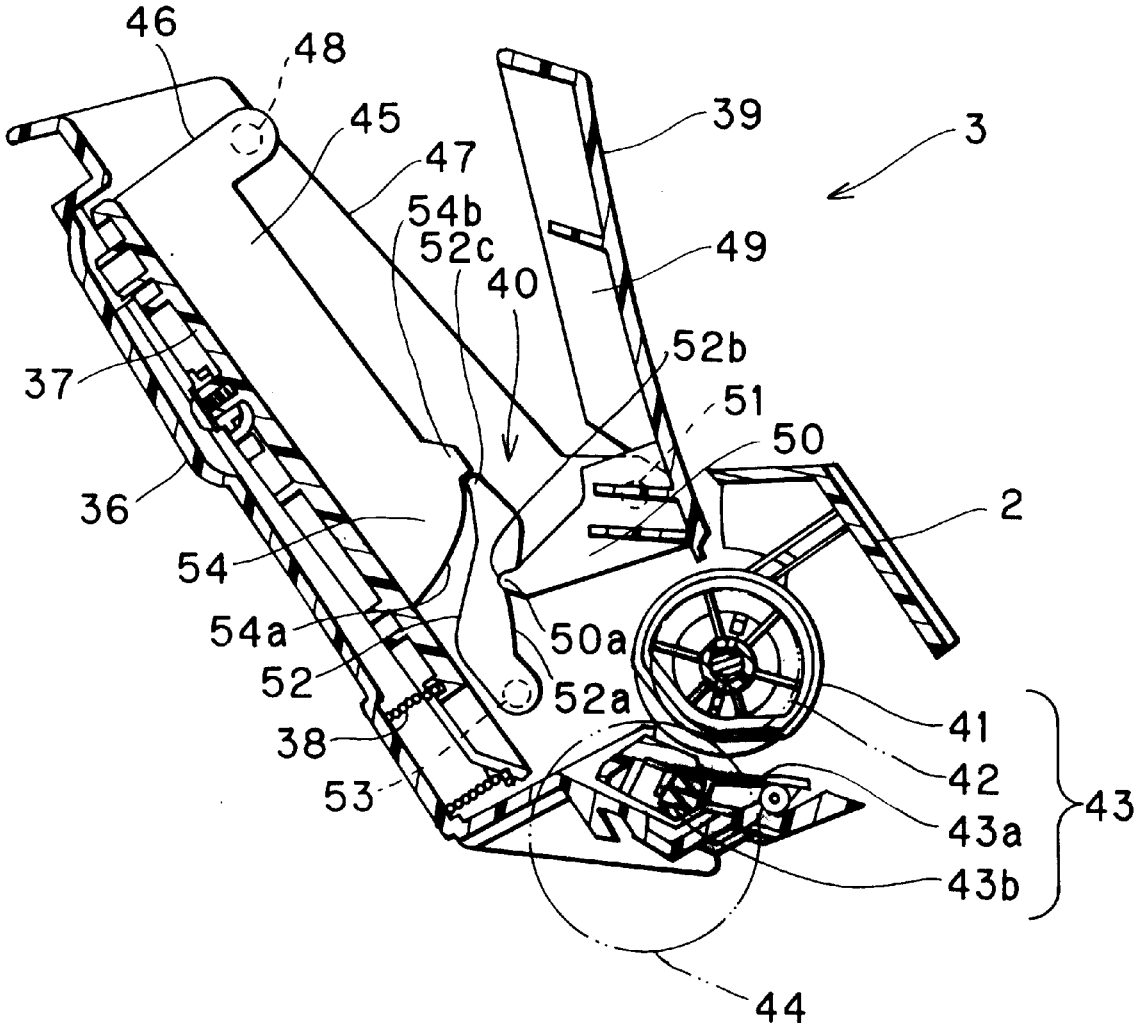
FIG. 5 is a side cross-sectional view showing the first sheet feed tray unit with the tray cover open.

As described above, the first sheet feed tray unit 3 is fixedly provided on the top surface near the back end of the body case 2. As shown in FIGS. 4 and 5, the first sheet feed tray unit 3 includes a tray case 36, a sheet receiving plate 37, a compression coil spring 38, a tray cover 39, a release mechanism 40, and the first sheet supplying mechanism 43. The tray case 36 is adapted to contain a sheet stack at a backward rising inclination. The sheet receiving plate 37 is provided on the bottom of the tray case 36 for receiving the bottom surface of the sheet. The compression coil spring 38 is adapted for urging the sheet receiving plate 37 forward. The tray cover 39 is positioned in confrontation with the front side of the sheet receiving plate 37 and is pivotally attached to a portion near the lower end of the tray case 36 for pivotably opening and closing an upper surface of the sheet stack by a prescribed angle. The release mechanism 40 is adapted for releasing the sheet receiving plate 37 backward against biasing force of the coil spring 38, the releasing operation being performed interlockingly with the opening operation of the tray cover 39. The first sheet supplying mechanism 43 includes a sheet supply roller 41, an intermittent sheet supply gear 42 provided on one axial end of the sheet supply roller 41, a pressure member 43*a*, to which pressure is applied by the sheet supply roller 41, and a spring 43*b* for urging the pressure member 43*a*. The intermittent sheet supply gear 42 is meshedly and selectively engageable with a drive gear 44 of the drive unit. The tray case 36 is about half the length of an A4-size sheet of sheet, for example. However, a supplemental sheet receiving member (not shown) constructed from wire can be removably mounted on the top end of the tray case 36 in order to support the portion of sheet extending out from the tray case 36.

The sheet receiving plate 37 has left and right side walls 45, and pivot support portions 46 are formed on the top ends of the side walls 45. The tray case 36 has left and right side walls 47, and the pivot support portions 46 are pivotally movably supported to the side walls 45 by horizontally extending pivot support pins 48. The tray cover 39 includes a pair of left and right side walls 49 and a pair of left and right arms 50 integrally formed on the lower side of the side walls 49 and extending backward. The pair of arms 50 are pivotally movably connected to the side walls 47 of the tray case 36 by horizontally extending pivot pins 51, enabling the tray cover 39 to pivotally move about its lower end. When replenishing the first sheet feed tray unit 3 with sheets, the tray cover 39 is pivotally moved to its open position shown in FIG. 5, by pulling the tray cover 39 forward to a prescribed angle. After filling the tray, the tray cover 39 is pushed back to its closed position shown in FIG. 4.

The release mechanism 40 will be described next. Release levers 52 are provided on the lower inside surfaces of the left and right side walls 47 on the tray case 36. Pins 53 are used to mount the lower ends of the release levers 52 on the side walls 47, allowing the levers to be pivotably moved. Engaging protrusions 50*a* are formed on the back ends of the lower portion of the arms 50. The front surfaces of the release levers 52 have lower halves formed with guide surfaces 52*a* for guiding the engaging protrusions 50*a*. That is, the engaging protrusions 50*a* are slidingly movable with respect to the guide surfaces 52*a*. Notches 52*b* are formed in the middle front surfaces of the release levers 52 for engaging the engaging protrusions 50*a*. Further, pushing portions 52*c* are formed on the top back ends of the release levers 52. The side walls 45 of the sheet receiving plate 37 have lower end portions serving as follower plates 54. The lower end surfaces of the follower plates 54 are formed in arc-shaped sliding surfaces 54*a*, and have engaging portions 54*b* at each top of the sliding surface 54*a*. The pushing portions 52*c* are slidable on the arcuate sliding surfaces 54*a* and are engageable with the engaging portions 54*b*.

When the tray cover 39 is in the closed position shown in FIG. 4, the pushing units 52*c* of the release levers 52 are in contact with the sliding surfaces 54*a*. When the tray cover 39 is changed to the open position shown in FIG. 5, the engaging protrusions 50*a* of the arms 50 on the left and right sides of the tray cover 39 move both upward and backward, guided along the guide surfaces 52*a* of the release levers 52 until the engaging protrusions 50*a* is engaged with the notches 52*b* for pushing the release levers 52 backward. As a result, the pushing portions 52*c* push the sliding surfaces 54*a* backward, causing the sheet receiving plate 37 to pivot backward (in clockwise direction in FIG. 5). Therefore, a stack of sheets can be set into the tray case 36.

Hence, when the tray cover 39 is changed to the open position, the sheet receiving plate 37 is set in a release state and is stabilized because the pushing portions 52*c* are engaged with the engaging portions 54*b*. Here, the movement of the engaging protrusions 50*a* is greatly amplified by means of the release levers 52, utilizing the lever principle, and is transferred to the follower plates 54. Hence, the tray cover 39 need only pivot a small amount to release the sheet receiving plate 37. As a result, the gap between the first and second sheet feed tray units 3 and 4 can be made small, allowing both tray units 3 and 4 to be arranged compactly in the body case 2.

Figure 6:
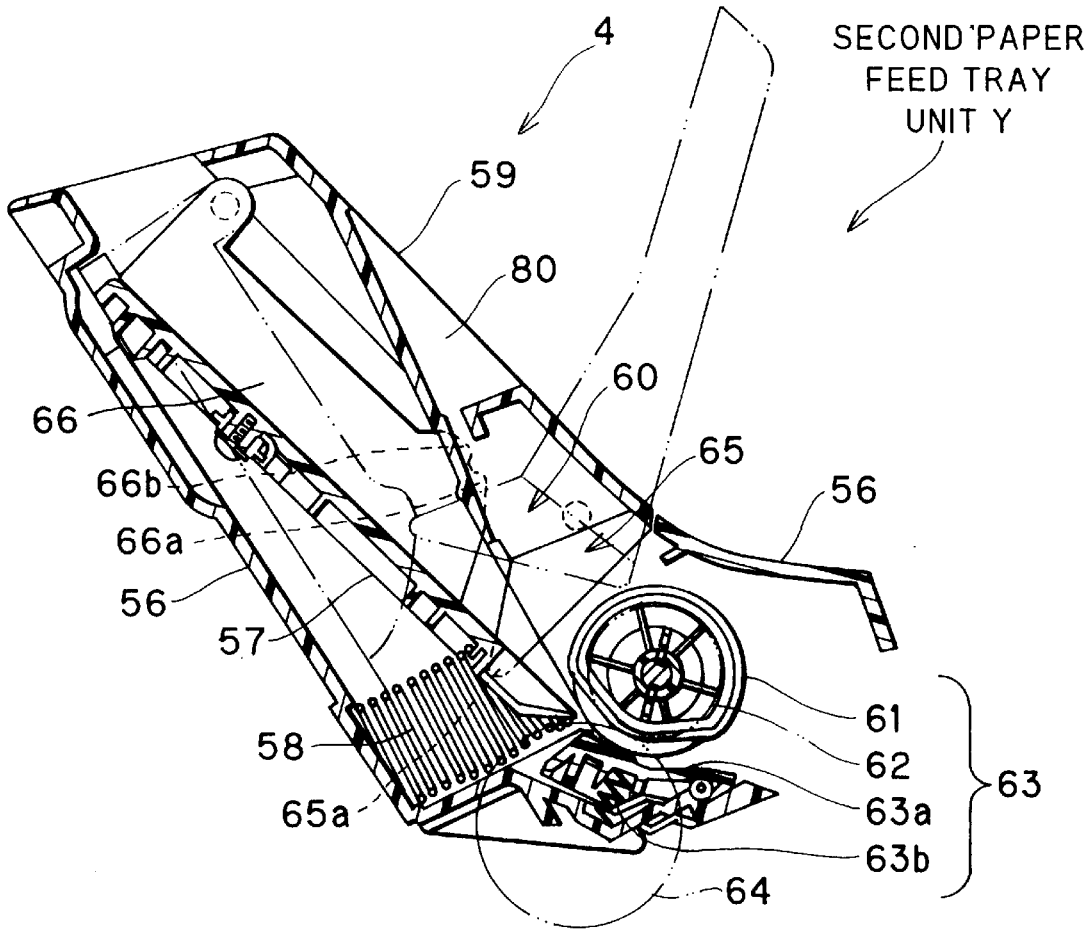
FIG. 6 is a side cross-sectional view showing a second sheet feed tray unit with a tray cover closed according to the embodiment.
Figure 7:
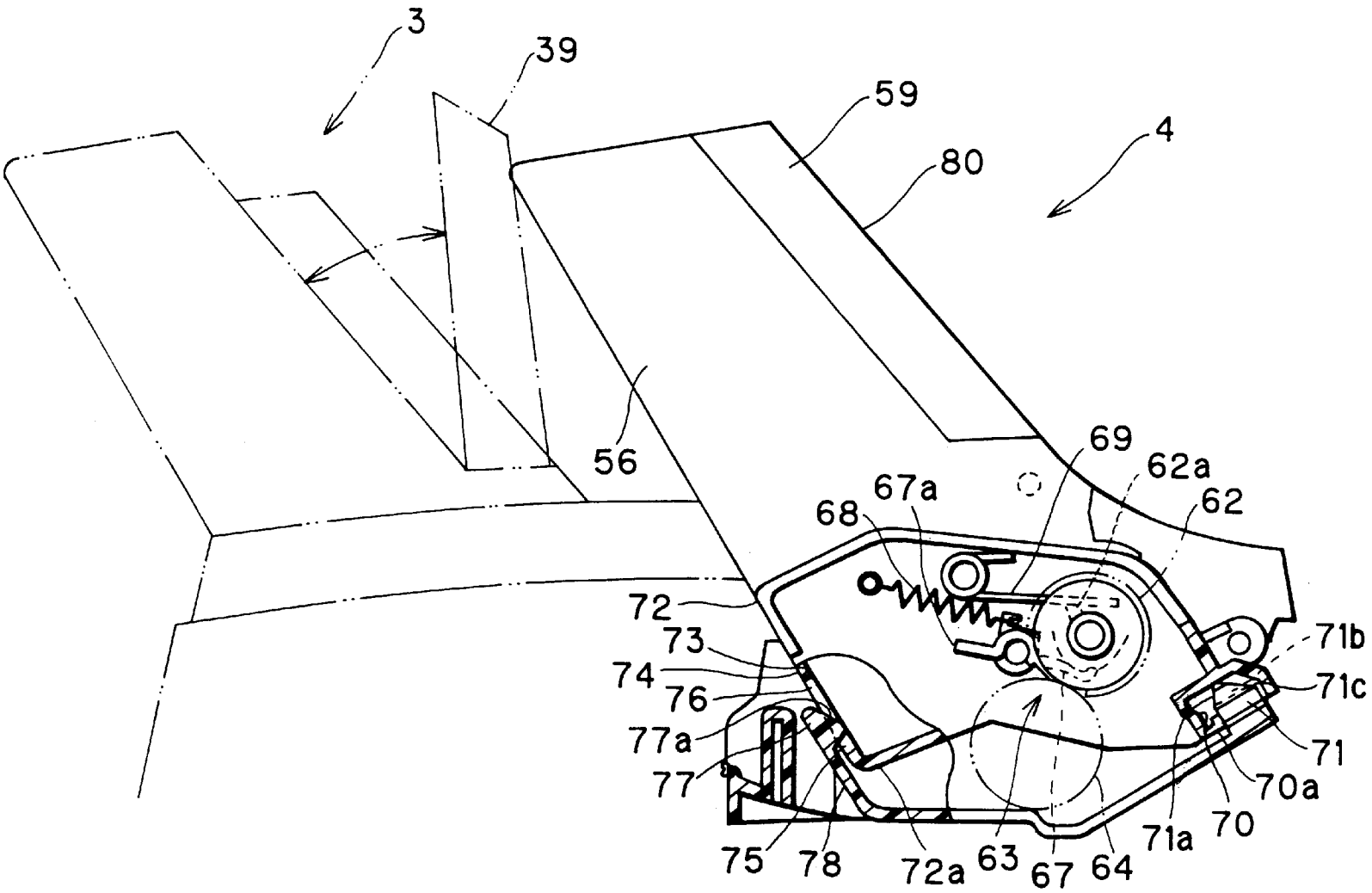
FIG. 7 is a side cross-sectional view showing the second sheet feed tray unit and an essential portion of a body case according to the embodiment.
Figure 9:
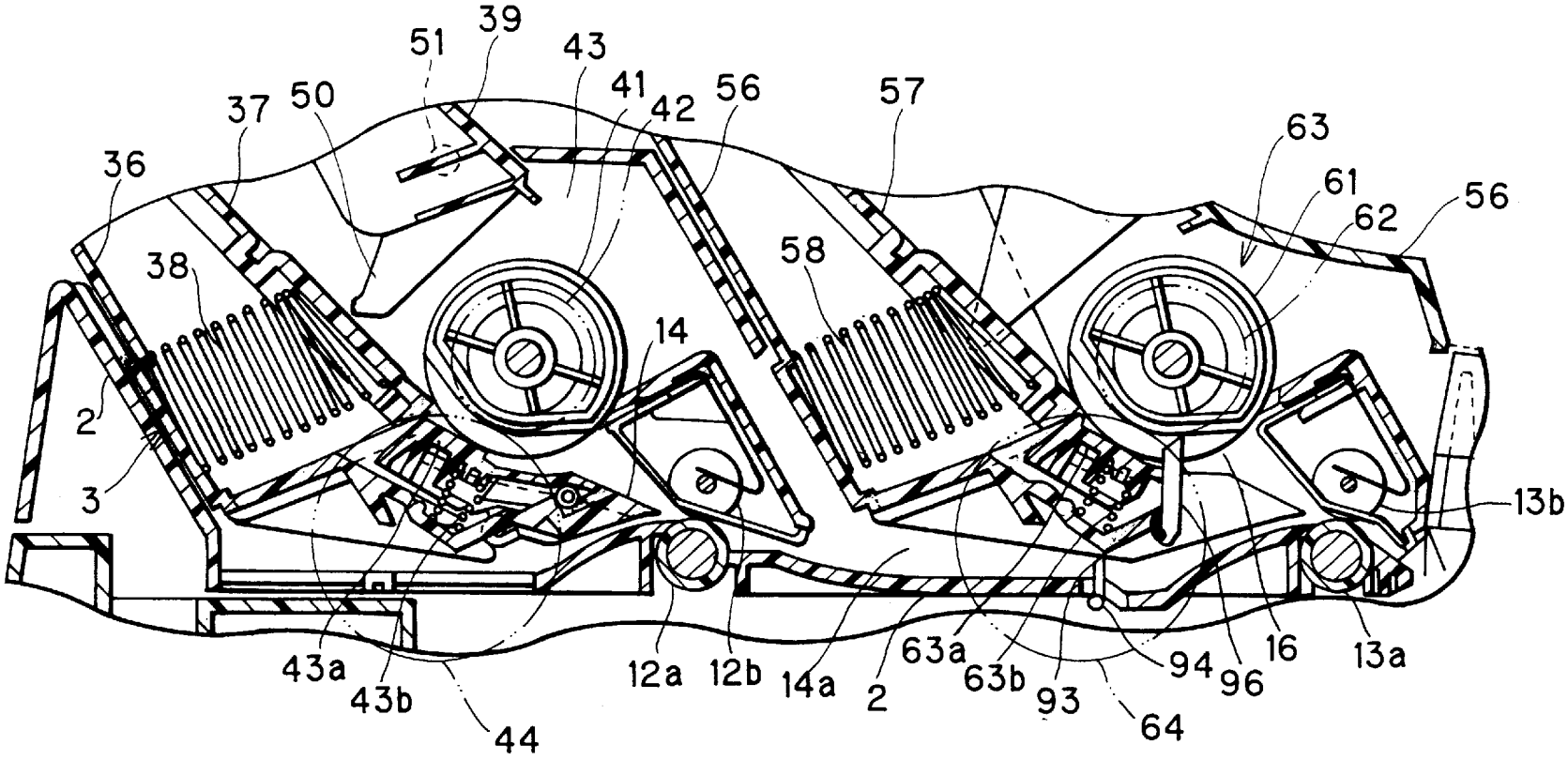
FIG. 9 is an enlarged cross-sectional view showing each lower end portion of the first and second sheet feed tray units according to the embodiment.

The second sheet feed tray unit 4 is detachably mounted on the rear portion of the body case 2 and in front of the first sheet feed tray unit 3 as described above. As shown in FIGS. 6 and 7, the second sheet feed tray unit 4 includes a tray case 56, a sheet receiving plate 57, a compression coil spring 58, a tray cover 59, a release mechanism 60 and a second sheet supply mechanism 63. The tray case 56 is capable of containing a plurality of sheets of sheet stack at a backward rising inclination. The tray case 56 is about half the length of an A4-size sheet of sheet, for example. However, an auxiliary sheet receiving member (not shown) constructed from wire can be removably mounted on the top end of the tray case 56 in order to support the portion of sheet extending out from the tray case 56.

The sheet receiving plate 57 is provided on the bottom of the tray case 56 for receiving the bottom surface of the sheet. The compression coil spring 58 is adapted for urging the sheet receiving plate 57 forward. The tray cover 59 is positioned in confrontation with the front side of the sheet receiving plate 57. The lower end portion of the tray cover 59 is pivotally attached to the tray case 56 so that the tray cover 59 can be pivotally moved by a prescribed angle. The release mechanism 60 is adapted for moving or releasing the sheet receiving plate 57 rearwardly against the biasing force of the compression coil spring 58 in interlocking relationship with the opening movement of the tray cover 59. The second sheet supply mechanism 63 will be described later.

The mechanisms for pivotally supporting the sheet receiving plate 57 on the tray case 56 and for pivotally supporting the tray cover 59 on the tray case 56 are the same as those in the first sheet feed tray unit 3. However, the release mechanism 60 is configured differently from the release mechanism 40 of the first sheet feed tray unit 3. More specifically, a pair of left and right arms 65 are formed on the tray cover 59, and pushing portions 65*a* are formed on the ends of the arms 65. A pair of left and right side walls 66 serving as follower plates are formed on the left and right of the sheet receiving plate 57. Sliding surfaces 66*a* are formed on the front sides of the left and right side walls 66 and in alignment with the pushing portions 65*a*. Further, engaging portions 66*b* are formed at each top portion of the sliding surface 66*a*. The pushing portions 65*a* slide along the sliding surfaces 66*a* directly pushing the same until the pushing portions 65*a* are brought into engagement with the engaging portions 66*b*, at which time the sheet receiving plate 57 has completed the change to the release position. Since there are no obstacles in front of the second sheet feed tray unit 4, there are no great restrictions on the pivotally moving angle of the tray cover 59 required for changing the tray cover 59 to the open position. Hence, there is no need for an amplifying mechanism such as the release lever 52 of the release mechanism 40.

Next, the configuration for mounting the second sheet feed tray unit 4 in the body case 2 from above and fixing the same at a prescribed position in relation to the body case 2 will be described.

As shown in FIG. 7, a pair of left and right engaging holes 70 are formed on the underside and near the front end of the tray case 56. Each hole 70 is open at its lower end. A pair of left and right engaging protrusions 71 are formed in the portion of the body case 2 that the second sheet feed tray unit 4 is mounted for engaging with the left and right engaging holes 70. Formed on the top of each engaging protrusion 71 are guiding surfaces 71*a* for guiding rear inner contact portions 70*a* on the engaging holes 70, guiding surfaces 71*b* for guiding lateral inner sides of the engaging holes 70, and guiding surfaces 71*c* for guiding the front inner contact portions of the engaging holes 70.

Figure 8:
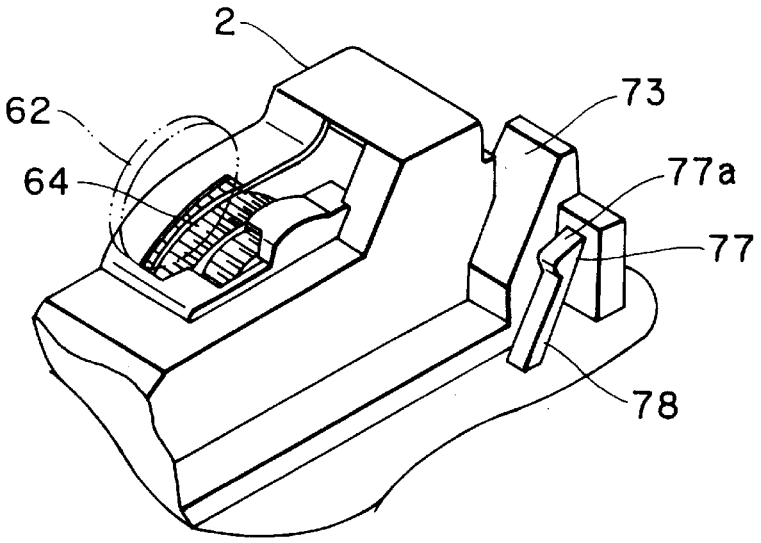
FIG. 8 is a perspective view showing an essential portion on a side of a case according to the embodiment.

As shown in FIGS. 7 and 8, a back wall 72 is formed on the tray case 56. A pair of left and right engagement receiving surfaces 73 sloping downward in the front are formed on the portions of the body case 2 at positions corresponding to the lower left and right ends of the back wall 72 of the tray case 56. A pair of left and right contact portions 74 are formed on the lower end of the back wall 72 of the tray case 56 and come to rest on the engagement receiving surfaces 73 of the body case 2. When the pair of engaging protrusions 71 engage with the pair of engaging holes 70, the left and right and front and rear directional position of the second sheet feed tray unit 4 is provisionally fixed. Further, the engaging protrusions 71 contact the top wall of the engaging holes 70 to fix the up and down position of the front end of the second sheet feed tray unit 4. The pair of contact portion rest on the engagement receiving surfaces 73, fixing the up and down position for the back end of the second sheet feed tray unit 4.

Moreover, as shown in FIG. 2, lower side wall portions 56*a* are formed in the tray case 56. When the second sheet feed tray unit 4 is mounted in the body case 2, the lower end of the side walls 56*a* are stopped by receiving portions 2*a* formed in the side walls of the body case 2, and the lower back half of the left and right side walls 56*a* are stopped by another receiving portions 2*b* formed in the side walls of the body case 2.

As shown in FIG. 7, a pair of left and right fastening edges 75 and fastening holes 76 are formed in the lower end of the back wall 72 of the tray case 56. A pair of flexible left and right fastening protrusions 77 are provided on the back ends of the area of the body case 2 in which the second sheet feed tray unit 4 is mounted and are positioned to correspond with the pair of fastening edges 75 and fastening holes 76. The fastening protrusions 77 are formed at the top ends of arms 78, which are capable of flexibly moving forward and backward. Guiding surfaces 77*a* that slope downward toward the front are formed on the front of the fastening protrusions 77. Hence, the fastening protrusions 77 penetrate the fastening holes 76 and engage with the fastening edges 75 on the lower sides of the fastening holes 76.

As described above, when lowering the second sheet feed tray unit 4 into the body case 2, the left and right engaging portions 71 are engaged with the left and right engaging holes 70. When the second sheet feed tray unit 4 is pushed further downward, lower corners 72a formed in the back wall 72 of the tray case 56 push against the guiding surfaces 77*a* of the left and right fastening protrusions 77. The left and right fastening protrusions 77 engage with the left and right fastening holes 76 by means of the resiliency of the arms 78. Thus, the left and right fastening edges 75 are fixed. By the left and right fastening protrusions 77.

To remove the second sheet feed tray unit 4 from the body case 2, the tray case 56 is pulled upward, allowing the left and right fastening edges 75 to be easily removed from the fastening protrusions 77 and the left and right engaging holes 70 to be easily disengaged from the engaging units 71, so that the second sheet feed tray unit 4 can be easily removed from the body case 2.

Next, the second sheet feed mechanism 63 provided in the second sheet feed tray unit 4 will be described. As shown in FIGS. 6 through 8, the second sheet feed mechanism 63 includes a sheet supply roller 61, a sheet supply intermittent gear 62, a pressure member 63*a*, and a biasing spring 63*b*. The sheet supply roller 61 is rotatably mounted on the lower and slightly forward portion of the tray case 56 by means of a horizontal roller shaft oriented in the left-to-right direction. The sheet supply intermittent gear 62 is fixed near the left end of the roller shaft. The above described sheet conveying path 16 is positioned immediately below the sheet supply roller 61. The pressure member 63*a* is disposed at a lower end portion of the tray case 56. The pressure member 63*a* is adapted to be pushed downwardly by the sheet supply roller 61. The biasing spring 63*b* is adapted to urge the pressure member 63*a* upwardly against the pressing force from the sheet supply roller 61. A driving gear 64 is provided in the body case 2 and positioned corresponding to the intermittent gear 62, so that the driving gear 64 is meshedly engaged with the sheet supply intermittent gear 62 when the second sheet feed tray unit 4 is mounted in the body case 2. This drive gear 64 is provided so as to be partially exposed externally when the second sheet feed tray unit 4 is removed from the body case 2.

The second sheet feed mechanism 63 further includes an engaging lever 67 engageable with the sheet supply intermittent gear 62, and a spring 68 for urging the engaging lever 67 into engagement with the sheet feed intermittent gear 62. The engaging lever 67 has an input portion 67*a* engaged with an output rod of an electromagnetic actuator (not shown). Further, the sheet supply intermittent gear 62 has a projection 62*a* to which a torsion spring 69 is connected, so that supply intermittent gear 62 is urged to rotate in the counterclockwise direction in FIG. 7 by the biasing force of the torsion spring 69.

The drive unit including the above described driving gears 44 and 64 is positioned within the left side portion of the body case 2. The drive gear 64 is driven by a gear train in the drive unit. When supplying sheet from the second sheet feed tray unit 4 in the state shown in FIG. 7, the electromagnetic actuator (not shown) is momentarily switched on, so that the engaging lever 67 is disengaged from the intermittent gear 62 against the biasing force of the coil spring 68. As a result, the sheet supply intermittent gear 62 can be rotated in the counterclockwise direction by the torsion spring 69 and protrusion 62*a*, and is brought into engagement with the already rotating drive gear 64, and rotates approximately one revolution, causing the sheet supply roller 61 to rotate the same amount. As a result, one sheet contained in the second sheet feed tray unit 4 is supplied by the sheet supply roller 61, after which the engaging lever 67 is brought into engagement with the intermittent gear 62 to restore the state shown in FIG. 7.

Incidentally, the first sheet feed mechanism 43 for the first sheet feed tray unit 3 is provided in the body case 2. The structure for the intermittent rotation of the first sheet supply roller 41 is the same as the above described structure (such as the electromagnetic actuator, the engaging lever 67, the coil spring 68 and the torsion spring 69).

As shown in FIGS. 1 and 6, a manual sheet insertion port 80 is provided in the front side of the second sheet feed tray unit 4 for manually feeding one sheet. The front surface of the tray cover 59 serves as a manual sheet insertion passage directing to the second sheet supply roller 61. If sheet is manually inserted into the manual sheet insertion port 80 when the second sheet feed mechanism 63 operates, the manually inserted sheet is first registered by the pair of register rollers 13*a* and 13*b* and then supplied to the processing unit 7.

Next, a sheet detection mechanism 81 will be described with reference to FIGS. 9 through 12. The sheet detection mechanism 81 generally includes a first detection member 82 for detecting a leading end of the sheet supplied from the first sheet feed tray unit 3, a second detection member 83 for detecting a leading end of the sheet supplied from the second sheet feed tray unit 4, a first pivot lever 84, a tension spring 85, a second pivot lever 86 and a detection sensor 87 such as a photo-interrupter.

Figure 12:
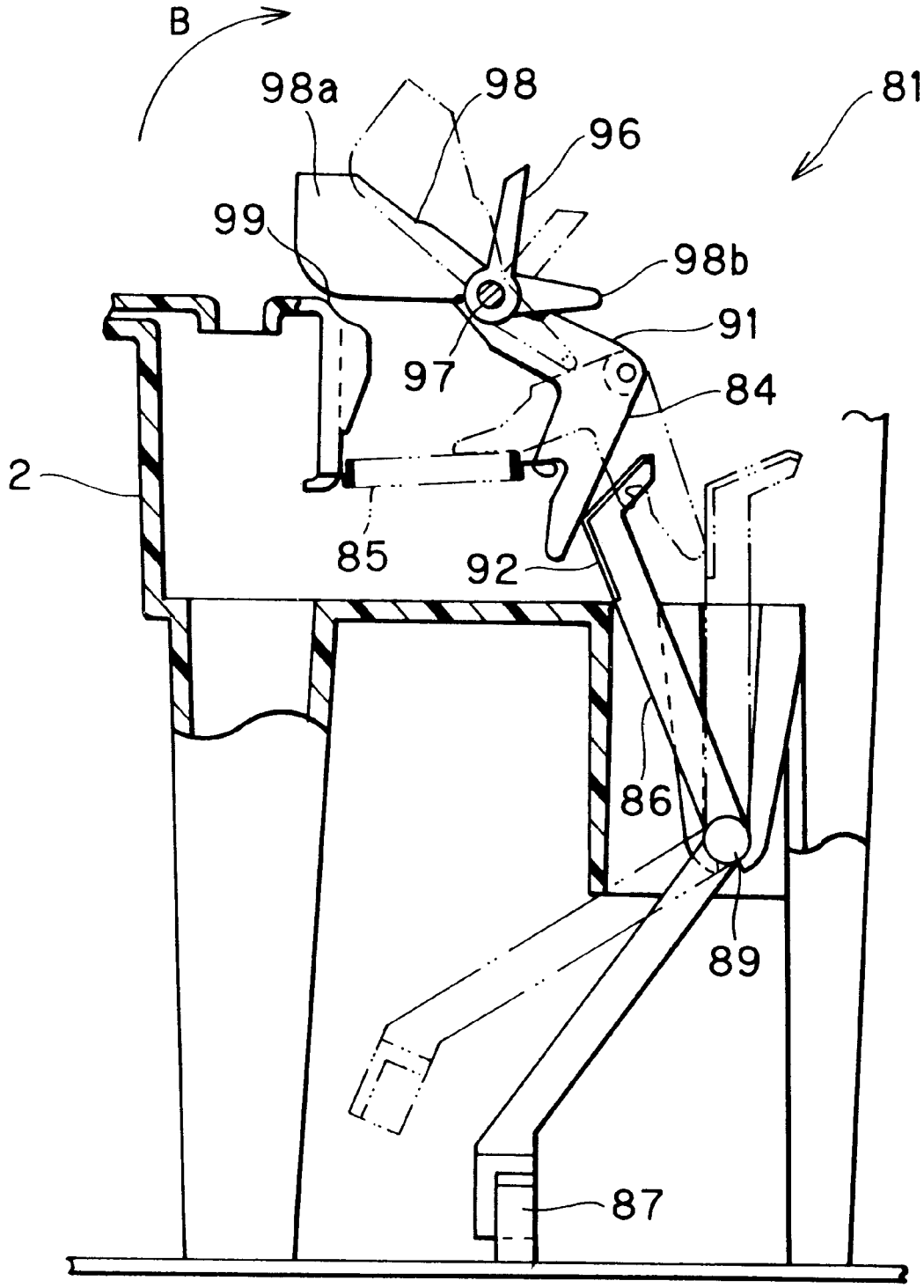
FIG. 12 is a side view showing operation of the sheet detection mechanism which detects a sheet supplied from the second sheet feed tray unit.

The first pivot lever 84 is pivotally movably supported to the body case 2 by a pivot shaft 88. The first pivot lever 84 is connected to one end of the tension spring 85 so that the first pivot lever 84 is pivotally moved in a clockwise direction in FIGS. 9 and 10. The other end of the tension spring 85 is connected to the body case 2 as shown in FIG. 12. The first pivot lever 84 has a L-shape configuration having a vertically extending arm portion and a horizontally extending arm portion whose upper surface is formed with a first engaging portion 90 and a second engaging portion 91 arranged in stepwise relation with respect to the first engaging portion 90. The second pivot lever 86 is pivotally movably supported to the body case by a pivot shaft 89, and has an upper arm provided with a receiving plate 92. The vertically extending arm portion of the first pivot lever 84 is positioned behind and in abutment with the receiving plate 92. The second pivot lever 86 has a lower arm whose free end can be in selective alignment with the detection sensor 87 by the pivotal movement of the second pivot lever 86. When the free end of the lower arm of the second pivot lever 86 is in alignment with the detection sensor 87, the detection sensor 87 generates OFF signal. When the free end is moved away from the detection sensor 87, the sensor 87 generates ON signal.

As described above, the sheet feed path 14 includes the underside conveying path 14*a* extending along the lower surface of the second sheet feed tray unit 4, and the sheet P from the first sheet feed tray unit 3 is fed on the conveying path 14*a*. The first detection member 82 includes a first detection piece 93, a horizontal rod 94 and an engaging piece 95 these being an integrally molded product formed of a resin. The horizontal rod 94 is rotatably supported by the body case 2, and the first detection piece 93 is projectable into the conveying path 14*a* at a widthwise center portion thereof, and is integrally with the horizontal rod 94 at a longitudinally center portion thereof. The engaging piece 95 integrally extends from one longitudinal end of the horizontal rod 94 in a direction perpendicular thereto. The engaging piece 95 is of L shape configuration provided with an engagement portion 95*a* extending in parallel with the rod 94. The first engagement portion 90 of the first pivot lever 84 is abuttable on the engaging portion 95*a*, so that a clockwise rotation of the first pivot lever by the biasing force of the tension spring 85 in FIG. 10 can be stopped.

If the sheet is not supplied from the first sheet feed tray unit 3, the first detection piece 93 maintains its upstanding position by the biasing force of the tension spring 85. Therefore, the free end of the second pivot lever 87 is in alignment with the detection sensor 87 to render the detection sensor 87 OFF.

Figure 10:
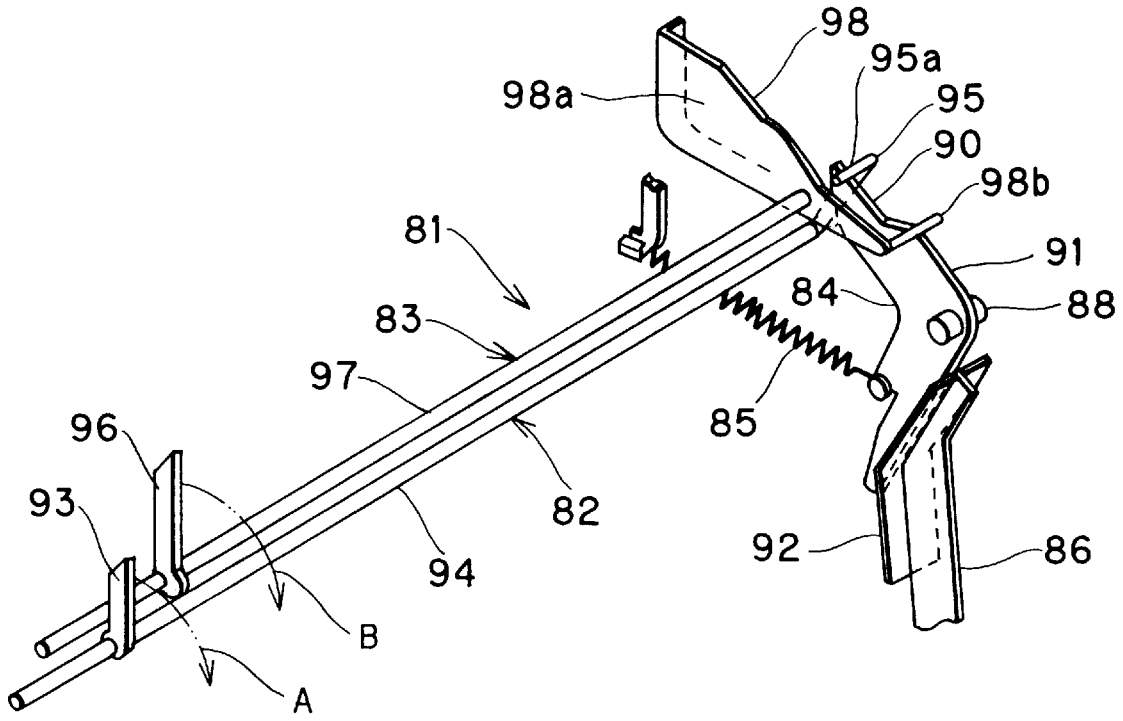
FIG. 10 is a perspective view showing a sheet detection mechanism according to the embodiment.
Figure 11:
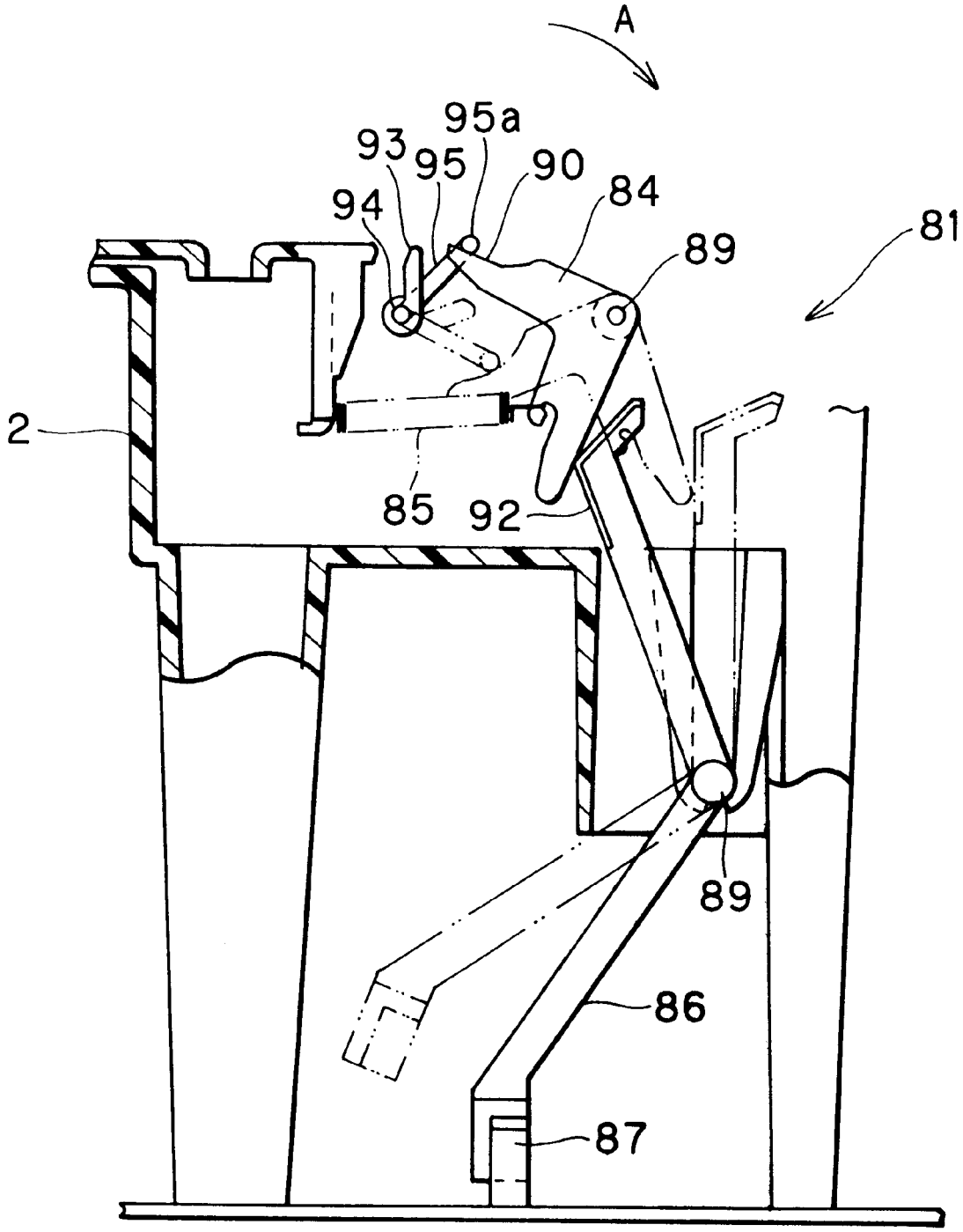
FIG. 11 is a side view showing operation of the sheet detection mechanism which detects a sheet supplied from the first sheet feed tray unit.

If the sheet supplied from the first sheet feed tray unit 3 is brought into abutment with the rear face of the first detection piece 93, the first detection piece 93 is pivotally moved in a clockwise direction (FIG. 10) as indicated by an arrow A, so that the engaging portion 95*a* of the engaging piece 95 pushes the engaging portion 90 of the first pivot lever 84 downwardly against the biasing force of the tension spring 85, that is the first pivot lever 84 is pivotally moved in the counterclockwise direction in FIG. 10. Accordingly, as shown in FIG. 11, the first and second pivot levers 84 and 86 are pivotally moved from their solid line positions to two dotted line positions. Thus, the free end portion of the second pivot lever 86 is moved away from the detection sensor 87 to render the detection sensor 87 ON.

The second detection member 83 is provided in the second sheet feed tray unit 4. The second detection member 83 includes a second detection piece 96, a horizontally extending rod 97 and an engaging piece 98 those being integrally molded with a resin. The rod 97 is rotatably supported by the tray case 56. The second detection piece 96 is projectable into the second conveying path 16 at a position immediately below the second sheet supplying mechanism 63, and is integrally with the horizontal rod 97 at a longitudinally center portion thereof.

The engaging piece 98 integrally extends from one longitudinal end of the horizontal rod 97 in a direction perpendicular thereto. The engaging piece 98 has one end portion provided with a weight portion 98*a* and another end portion provided with a pin 98*b*. The weight portion 98*a* is adapted for normally rotating the horizontally extending rod 97 about its axis in a counterclockwise direction in FIG. 10. As shown in FIG. 12, the body case 2 has a seat portion 99 on which the weight portion 98*a* can be seated. Therefore, the counterclockwise rotation of the rod 97 about its axis can be limited so that the second detection piece 96 can maintain its upstanding position. The engaging pin 98*b* is abuttable on the second engaging portion 91 of the first pivot lever 84 when the engaging piece 98 is pivotally moved in the clockwise direction in FIG. 10.

If the sheet supplying operation is not performed in the second sheet feed tray unit 4, the second detection piece 96 maintains its upstanding position by seating of the weight portion 98*a* on the seat portion 99. If the sheet supplying operation is performed in the second sheet feed tray unit 4, the leading end of the sheet P pushes the second detection piece 96 so that the second detection piece 96 is pivotally moved in a clockwise direction (FIG. 10) as indicated by an arrow B. Consequently, the engaging piece 98 is also pivotally moved in the clockwise direction against the gravity of the weight portion 98*a*, and the engaging pin 98*b* of the engaging piece 98 pushes the second engaging portion 91 of the first pivot lever 84 downwardly against the biasing force of the tension spring 85. That is, the first pivot lever 84 is pivotally moved in the counterclockwise direction in FIG. 10. Accordingly, as shown in FIG. 12, the second pivot lever 86 is pivotally moved from its solid line position to the two dotted line position. Thus, the detection sensor 87 is rendered ON. The detection sensor 87 is commonly used for detecting the sheet supplied from the first sheet feed tray unit 3 and from the second sheet feed tray unit 4.

In the above described embodiment, various advantages can be attained as described below.

(1) Since two tray units are provided in the laser printer, the total amount of sheet that can be loaded into the printer can be greatly increased, decreasing the frequency of reloading, by loading the same type of sheet in both the first and second sheet feed tray units 3 and 4. Alternatively, the two tray units can each be loaded with a different size of sheet, allowing different sizes of sheet to be selectively and alternatively supplied and decreasing the frequency of exchanging tray units when a different size of sheet is desired.

(2) Further, since the first and second sheet feed tray units 3 and 4, which maintain sheet in a state sloping upward to the back, are provided in the top back surface of the body case 2, only a small amount of the first sheet feed tray unit 3 protrudes over the back end of the body case 2, allowing the printer 1 to have a short overall length so as not to occupy a large area. Further, the overall height of the body case 2 need not be increased, since two tray units are not set to a vertical side of the body case, but are set on the upper horizontal side thereof.

(3) Since the second sheet feed tray unit 4 is removable from the body case, the underside conveying path 14*a* along the lower surface of the second sheet feed tray unit 4 can be revealed by removing the second sheet feed tray unit 4. Accordingly, sheet that becomes jammed along the conveying path 14 extending from the first sheet feed tray unit 3 can be easily removed.

(4) The second sheet feed mechanism 63, including the sheet supply roller 61 and the sheet supply intermittent gear 62 is provided in the second sheet feed tray unit 4 rather than in the body case 2. Therefore, the construction required for mounting the second sheet feed tray unit 4 in the body case 2 can be simplified, and mounting of the second sheet feed tray unit 4 can be facilitated. When mounting the second sheet feed tray unit 4, the power transmission system for transmitting drive force from the drive gear 64 to the sheet supply intermittent gear 62 can be simplified since the sheet feed intermittent gear 62 is capable of engaging with the drive gear 64 provided in the body case 2 when the second sheet feed tray unit 4 is mounted on the body case 2. Thus, entire power transmission mechanism can be simplified.

(5) By configuring the greatest part of the sheet conveying path 14 for feeding sheet from the first sheet feed tray unit 3 in the underside conveying path 14*a* extending along the lower surface of the second sheet feed tray unit 4, and by providing the register rollers 13*a* and 13*b* in the sheet conveying mechanism 5 near the front side of the second sheet feed tray unit 4, sheet alternatively supplied from the first and second sheet feed tray units 3 and 4 can be subjected to position registration by the register rollers 13*a*, 13*b* and can be conveyed to the processing unit 7. Since the register rollers 13*a*, 13*b* are positioned near the front side of the second sheet feed tray unit 4, a length of the sheet conveying passage 16 from the second sheet feed tray unit 4 to the register rollers 13*a* , 13*b* can be reduced.

(6) When mounting the second sheet feed tray unit 4 in the body case 2, the pair of left and right engaging holes 70 in the tray case 56 are engaged with the pair of left and right engaging protrusions 71 on the body case 2, and the pair of left and right contact portions 74 are contacted with the pair of left and right engagement receiving surfaces 73. Therefore, the second sheet feed tray unit 4 can be easily and reliably set in an accurate position. Further, by engaging the pair of left and right fastening edges 75 of the tray case 56 with the pair of left and right resilient fastening protrusions 77 of the body case 2, the second sheet feed tray unit 4 can be fixed to the body case 2. The second sheet feed tray unit 4 can be easily mounted and dismounted smoothly into and from the body case 2 by the resilient deformation of the arms 78.

(7) The second sheet feed tray unit 4 includes the sheet receiving plate 57, the tray cover 59, and the release mechanism 60 for releasing the sheet receiving plate 57. Therefore, the sheet receiving plate 57 does not hinder the loading of sheet into the second sheet feed tray unit 4, and the sheet can be reloaded easily and smoothly.

(8) The manual sheet insertion port 80 is provided on the front surface of the second sheet feed tray unit 4. This allows sheet different from that contained in the first and second sheet feed tray units 3 and 4 to be manually supplied and printed.

(9) The first sheet feed tray unit 3 is provided with the sheet receiving plate 37, the tray cover 39, and the release mechanism 40. With this configuration, the sheet receiving plate 37 does not hinder the loading of sheet, and sheet can be reloaded easily and smoothly similar to the second sheet feed tray unit 4. Further, when the tray cover 39 is opened, the release mechanism 40 amplifies the moving stroke of the engaging units 50*a* on the ends of the arms 50 by means of the release lever 52 and transfers the amplified movement to the follower plates 54, allowing the angle of the opened tray cover 59 to be made small while reliably releasing the sheet receiving plate 37. As a result, the gap between the first and second sheet feed tray units 3 and 4 can be set small.

(10) Since the first detection piece 93 is positioned to protrude through the sheet conveying passage 14*a* positioned immediately below the second sheet feed tray unit 4, the first detection piece 93 can be positioned close to the register rollers 13*a*, 13*b*, thereby enhancing accuracy in sheet feeding toward the process unit 7. Further, inspection and maintenance to the first detection piece 93 can be easily performed by detaching the second sheet feed tray unit 4 from the body case 2.

(11) Since the second detection member 83 including the second detection piece 96 is provided to the second sheet feed tray unit 4, mechanical interference of the second detection member 83 against the first and second pivot levers 84 and 86 can be prevented when the second sheet feed tray unit 4 is mounted on or detached from the body case 2.

(12) Since the first and second pivot levers 84, 86 and the detection sensor 87 are commonly used in connection with the movement of the first and second detection pieces 93 and 96, and since the movement of the first and second detection pieces 93, 96 do not occur concurrently, entire sheet detection mechanism 81 can be simplified at low cost and in a compact fashion.

(13) Since the pair of feed rollers 12*a* and 12*b* are provided on the sheet conveying path 14*a*, the sheet supplied from the first sheet feed tray unit 3 can be surely fed to the pair of register rollers 13*a*, 13*b*.

While the invention has been described in detail and with reference to the specific embodiments thereof, it would be apparent to those skilled in the art that various changes and modifications may be made therein without departing from the spirit and scope of the invention.

For example, although in the depicted embodiment the first sheet feed tray unit 3 can be fixedly provided in the body case 2, this first sheet feed tray unit 3 can also be removably provided in the body case 2 in the same way as the second sheet feed tray unit 4. This configuration can be very beneficial in terms of manufacturing costs if both the first and second sheet feed tray units 3 and 4 have the same construction.

Further, although the description for the above embodiment applied to a laser printer 1, the present invention can be applied in the same way to other types of printers, as well, such as an ink-jet printer, thermal printer, and the like.

Further, in the depicted embodiment, the pair of engaging projections 71 and the pair of complementary engaging holes 70 are provided. However, the numbers of the projections and holes are not limited to the depicted embodiment.

Further, in the depicted embodiment, the resiliently deformable arms 78 having the fastening protrusions 77 are provided integrally with the body case 2. However, separate metallic and resiliently deformable arms having the protrusions can be fixed to the body case 2.

What is claimed is:

1. A printing device comprising:

a body case having a top surface;

a first sheet feed tray unit provided to the top surface and at a rearmost section thereof, the first sheet feed tray unit being in a backward rising inclination and replenishingly accommodating therein a plurality of sheets;

a second sheet feed tray unit detachably provided to the top surface and at a position in front of the first sheet feed tray unit, the second sheet feed tray unit being in a backward rising inclination and replenishingly accommodating therein another plurality of sheets, wherein a first sheet feed passage is provided along which a sheet supplied from the first sheet feed tray unit travels, the first sheet feed passage extending over a position immediately below the second sheet feed tray unit and being open when the second sheet feed tray unit is detached from the body case; and a drive source, a first drive gear driven by the drive source and a second drive gear driven by the drive source, the drive source and the first and second drive gears being disposed in the body case, wherein the second sheet feed tray unit includes, a tray case for storing the other plurality of sheets, a second sheet supply roller having a rotation shaft rotatable supported by the tray case, and a second intermittent rotation gear provided at the rotation shaft, the second intermittent rotation gear being meshedly engageable with the second drive gear when the second sheet feed tray unit is mounted to the body case.

2. The printing device as claimed in claim 1, wherein the first sheet feed tray unit comprises a first sheet supply roller having a rotation shaft and a first intermittent rotation gear provided at the rotation shaft and meshedly engageable with the first drive gear, the first sheet supply roller and the first intermittent rotation gear being provided to the body case.

3. The printing device as claimed in claim 1, wherein the second sheet tray unit comprises a second tray case for storing the other plurality of sheets, the second tray case being formed with at least one engaging recess and at least one engaging hole at positions in mating relation to the body case;

and wherein the body case is provided with at least one engaging portion engageable with the engaging recess, and at least one resilient locking projection engageable with the engaging hole when the tray case is mounted on the body case.

4. The printing device as claimed in claim 3, wherein the resilient locking projection is resiliently disengageable from the engaging hole when the second tray case is manually moved away from the body case.

5. The printing device as claimed in claim 1, wherein the first sheet feed tray unit comprises:

a first tray case oriented in a backward rising inclination, the first tray case having a bottom portion and a lower portion;

a first sheet supply roller provided at a position in front of the lower portion of the first tray case;

a sheet receiving plate positioned on the bottom portion of the first tray case and having a lower portion biased toward the first sheet supply roller, the plurality of sheets being stacked on the sheet receiving plate;

a tray cover positioned in front of the sheet receiving plate and pivotally movably supported to the lower portion of the first tray case, the tray cover providing a first pivot position in confrontation with the sheet receiving plate and a second pivot position for providing an open space over the sheet receiving plate; and a release mechanism provided at the first tray case, the sheet receiving plate and the tray cover for moving the lower portion of the sheet receiving plate away from the first sheet supply roller and for maintaining a moving away position in synchronization with the movement of the tray cover to the second pivot position.

6. The printing device as claimed in claim 5, wherein the release mechanism comprises:

an arm extending downwardly from the tray cover;

a release lever having one end pivotally movably supported to the first tray case and another end, the arm pushing the release lever to pivotally move the other end of the release lever downwardly in synchronism with the movement of the tray cover to its second pivot position;

a follower plate provided to the sheet receiving plate and having an engagement surface at the lower portion of the sheet receiving plate, the other end of the release lever being pushingly engageable with the engagement surface for amplifyingly moving the lower end portion of the sheet receiving plate in a direction away from the first sheet supply roller.

7. The printing device as claimed in claim 1, wherein second sheet feed tray unit comprises:

a second tray case oriented in a backward rising inclination, the second tray case having a bottom portion and a lower portion;

a second sheet supply roller provided at a position in front of the lower portion of the second tray case;

a sheet receiving plate positioned on the bottom portion of the second tray case and having a lower portion biased toward the second sheet supply roller, the other plurality of sheets being stacked on the sheet receiving plate;

a tray cover positioned in front of the sheet receiving plate and pivotally movably supported to the lower portion of the second tray case, the tray cover providing a first pivot position in confrontation with the sheet receiving plate and a second pivot position for providing an open space over the sheet receiving plate; and a release mechanism provided at the sheet receiving plate and the tray cover for moving the lower portion of the sheet receiving plate away from the second sheet supply roller and for maintaining a moving away position in synchronization with the movement of the tray cover to the second pivot position.

8. The printing device as claimed in claim 7, wherein a manual sheet insertion port is defined between the tray cover and the body case, the tray cover having an upper surface serving as a manual sheet insertion passage directing to the second sheet supply roller.

9. The printing device as claimed in claim 1, wherein the first sheet feed tray unit comprises a first sheet supply roller for supplying each one of the sheets in a sheet feeding direction;

and the printing device further comprising a pair of sheet feed rollers positioned immediately downstream of the first sheet supply roller at the first sheet feed passage for feeding the sheet supplied by the first sheet supply roller in the sheet feeding direction.

10. The printing device as claimed in claim 9, wherein the second sheet feed tray unit comprises a second sheet supply roller, and wherein a second sheet feed passage is defined in the second sheet feed tray unit from a position immediately downstream of the second sheet supply roller, the second sheet feed passage being oriented to join the first sheet feed passage at a meeting point at a position immediately downstream of the second sheet supply roller.

11. The printing device as claimed in claim 10, further comprising a pair of register rollers positioned immediately downstream of the meeting point for position-aligning the sheet supplied from either the first or second sheet feed tray unit.

12. The printing device as claimed in claim 11, further comprising a sheet detection mechanism comprising a first detection piece protrudable into and retractable from the first sheet feed passage for detecting a sheet fed from the first sheet feed tray unit; and a second detection piece protrudable into and retractable from the second sheet feed passage for detecting a sheet fed from the second sheet feed tray unit.

13. The printing device as claimed in claim 12, wherein the sheet detection mechanism further comprising:

a first lever movable in response to a movement of the first detection piece;

a second lever movable between a rest position and an operating position in response to a movement of the first lever, a single detection sensor positioned in alignment with the second lever to provide OFF signal when the second lever is moved to the rest position, and ON signal when the second lever is moved to the operating position; and a third lever movable in response to the movement of the second detection piece, the third lever being abuttable on the first lever to move the first lever.

14. A printing device comprising:

a body case having a top surface;

a first sheet feed tray unit provided to the top surface and at a rearmost section thereof, the first sheet feed tray unit being in a backward rising inclination and replenishingly accommodating therein a plurality of sheets;

a second sheet feed tray unit detachably provided to the top surface and at a position in front of the first sheet feed tray unit, the second sheet feed tray unit being in a backward rising inclination and replenishingly accommodating therein another plurality of sheets, the second sheet feed tray having a lower end;

a first passage means provided in the body case, a sheet supplied from the first sheet feed tray unit being fed in a sheet feeding direction on the first passage means, the first passage extending over a position immediately below the second sheet feed tray unit;

a register roller positioned in front of the lower end of the second sheet feed tray and along the first passage means for position-registering a sheet supplied from either the first sheet feed tray unit or the second sheet feed tray unit, the second sheet feed tray defining therein a second passage means directing to the register roller;

a sheet detection mechanism comprising a first detection piece protrudable into and retractable from the first passage means for detecting a leading end of a sheet fed from the first sheet feed tray unit and a second detection piece protrudable into and retractable from the second passage means for detecting a leading end of a sheet fed from the second sheet feed tray unit; and a transmitting unit connected to the first detection piece and the second detection piece and movable between a first position in response to a protruding position of the first detection piece and the second detection piece, and a second position in response to a retracting position thereof and a single sensor for detecting the first or second position of the transmitting unit, wherein the transmitting unit includes:

a first lever movable in response to a movement of the first detection piece;

a second lever movable between a rest position and an operating position in response to a movement of the first lever;

a third lever movable in response to the movement of the second detection piece, the third lever being abuttable on the first lever to move the first lever, the single sensor being positioned in alignment with the second lever to provide an OFF signal when the second lever is moved to the rest position, and an ON signal when the second lever is moved to the operating position, the rest position corresponding to the protruding position and the operating position corresponding to the retracting position; and a biasing member interposed between the first lever and the body case for maintaining the first detection piece at its protruding position, wherein the third lever has one end provided with a weight portion for maintaining the second detection piece at its protruding position and has another end abuttable against the first lever.

15. The printing device as claimed in claim 14, further comprising a pair of sheet feed rollers positioned immediately downstream of the first sheet supply roller at the first passage means for feeding the sheet supplied from the first sheet supply roller in the sheet feeding direction to the register roller.

* * * * *